US009728153B2

(12) United States Patent
Wang et al.

(10) Patent No.: US 9,728,153 B2
(45) Date of Patent: Aug. 8, 2017

(54) DISPLAY SYSTEM AND METHOD USING SET/RESET PIXELS

(71) Applicant: OmniVision Technologies, Inc., Santa Clara, CA (US)

(72) Inventors: Yunsheng Wang, San Jose, CA (US); Sunny Yat-san Ng, San Jose, CA (US)

(73) Assignee: OmniVision Technologies, Inc., Santa Clara, CA (US)

( * ) Notice: Subject to any disclaimer, the term of this patent is extended or adjusted under 35 U.S.C. 154(b) by 11 days.

(21) Appl. No.: 14/520,065

(22) Filed: Oct. 21, 2014

(65) Prior Publication Data

US 2016/0111036 A1 Apr. 21, 2016

(51) Int. Cl.

| | |
|---|---|
| ***G09G 5/399*** | (2006.01) |
| ***G09G 3/36*** | (2006.01) |
| *G09G 3/20* | (2006.01) |

(52) U.S. Cl.

CPC ..... *G09G 3/3685* (2013.01); *G09G 3/3648* (2013.01); *G09G 3/2014* (2013.01); *G09G 2300/0426* (2013.01); *G09G 2300/0857* (2013.01); *G09G 2310/0262* (2013.01); *G09G 2310/061* (2013.01); *G09G 2320/0295* (2013.01); *G09G 2330/021* (2013.01)

(58) Field of Classification Search

CPC ..... G09G 3/18; G09G 3/2003–3/2088; G09G 3/3406–3/3426; G09G 3/36–3/38; G09G 2300/0478–2300/0495; G09G 3/346; G09G 2300/0473; G02B 26/0833

See application file for complete search history.

(56) References Cited

U.S. PATENT DOCUMENTS

2006/0284900 A1 12/2006 Ng
2007/0176875 A1* 8/2007 Kageyama ..... G09G 3/3659 345/92
2008/0055216 A1 3/2008 Yen et al.
2009/0027360 A1 1/2009 Kwan et al.

(Continued)

FOREIGN PATENT DOCUMENTS

TW 2010/03621 A 1/2010

OTHER PUBLICATIONS

TW Application Serial No. 104123316, Office Action dated Jun. 22, 2016 (English translation).

*Primary Examiner* — Sanghyuk Park
(74) *Attorney, Agent, or Firm* — Larry E. Henneman, Jr.; Gregory P. Gibson; Henneman & Associates, PLC

(57) ABSTRACT

Displays and display driving methods implement a pixel set/reset scheme. Pixel cells of an example display each include a set terminal, a reset terminal, an output terminal, and a set/reset circuit. Responsive to receiving a set signal on the set terminal, the set/reset circuit asserts a first signal on the output terminal and maintains the first signal on the output terminal until a reset signal is received on the reset terminal. Responsive to receiving a reset signal on the reset terminal, the set/reset circuit asserts a second signal on the output terminal and maintains the second signal on the output terminal until a set signal is received on the set terminal. The optical output of the pixel depends on when the first signal and the second signal are asserted on the output terminal of the set/reset circuit during a predefined modulation period.

14 Claims, 15 Drawing Sheets

(56) References Cited

U.S. PATENT DOCUMENTS

| | | | | |
|---|---|---|---|---|
| 2009/0278829 | A1* | 11/2009 | Ishii | G09G 3/20 345/208 |
| 2011/0285688 | A1 | 11/2011 | Miyake et al. | |
| 2012/0092323 | A1 | 4/2012 | Murakami et al. | |

* cited by examiner

| $N_3$ | $N_2$ | $N_1$ | $N_0$ | Set | Reset |
|---|---|---|---|---|---|
| 0 | 0 | 0 | 0 | None | None |
| 0 | 0 | 0 | 1 | $t_0$ | $t_1$ |
| 0 | 0 | 1 | 0 | $t_0$ | $t_2$ |
| 0 | 0 | 1 | 1 | $t_0$ | $t_3$ |
| 0 | 1 | 0 | 0 | $t_0$ | $t_4$ |
| 0 | 1 | 0 | 1 | $t_0$ | $t_5$ |
| 0 | 1 | 1 | 0 | $t_0$ | $t_6$ |
| 0 | 1 | 1 | 1 | $t_0$ | $t_7$ |
| 1 | 0 | 0 | 0 | $t_0$ | $t_8$ |
| 1 | 0 | 0 | 1 | $t_0$ | $t_9$ |
| 1 | 0 | 1 | 0 | $t_0$ | $t_{10}$ |
| 1 | 0 | 1 | 1 | $t_0$ | $t_{11}$ |
| 1 | 1 | 0 | 0 | $t_0$ | $t_{12}$ |
| 1 | 1 | 0 | 1 | $t_0$ | $t_{13}$ |
| 1 | 1 | 1 | 0 | $t_0$ | $t_{14}$ |
| 1 | 1 | 1 | 1 | $t_0$ | $t_{15}$ |

FIG. 12A

| $B_3$ | $B_2$ | $B_1$ | $B_0$ | Set | Reset |
|---|---|---|---|---|---|
| 0 | 0 | 0 | 0 | None | None |
| 0 | 0 | 0 | 1 | $b_0$ | $b_1$ |
| 0 | 0 | 1 | 0 | $b_0$ | $b_2$ |
| 0 | 0 | 1 | 1 | $b_0$ | $b_3$ |
| 0 | 1 | 0 | 0 | $b_0$ | $b_4$ |
| 0 | 1 | 0 | 1 | $b_0$ | $b_5$ |
| 0 | 1 | 1 | 0 | $b_0$ | $b_6$ |
| 0 | 1 | 1 | 1 | $b_0$ | $b_7$ |
| 1 | 0 | 0 | 0 | $b_0$ | $b_8$ |
| 1 | 0 | 0 | 1 | $b_0$ | $b_9$ |
| 1 | 0 | 1 | 0 | $b_0$ | $b_{10}$ |
| 1 | 0 | 1 | 1 | $b_0$ | $b_{11}$ |
| 1 | 1 | 0 | 0 | $b_0$ | $b_{12}$ |
| 1 | 1 | 0 | 1 | $b_0$ | $b_{13}$ |
| 1 | 1 | 1 | 0 | $b_0$ | $b_{14}$ |
| 1 | 1 | 1 | 1 | $b_0$ | $b_{15}$ |

FIG. 12B

DISPLAY SYSTEM AND METHOD USING SET/RESET PIXELS

BACKGROUND OF THE INVENTION

Field of the Invention

This invention relates generally to display systems, and more particularly to display systems including an array of individual pixel cells. Even more particularly, this invention relates to display systems wherein pixel data is asserted on individual pixels of the display.

Description of the Background Art

Display systems including arrays of pixels upon which display data is asserted are well known. In prior art displays, the pixels are typically arranged in an array of columns and rows. Data lines are arranged along each column of pixels, and row lines are arranged along each row of pixels. An enable signal on a particular row line causes each pixel of the row to load the data bit being asserted on the respective column lines (usually two) associated with each particular pixel into an internal latch of the pixel. The latched data bit controls the intensity displayed by the associated pixel.

Multiple bits of data (e.g., 8 bits, 16 bits, or more) are sequentially loaded into each pixel to generate a single intensity value. Depending on the values of the data bits, the pixel switches between on/light (e.g., digital 1) and off/dark (e.g., digital 0) states, which are integrated by the eye of a viewer so that an intermediate intensity is perceived by the viewer.

Substantial power is consumed each time the column lines are recharged to write a digital 1 to a pixel. The number of times that the column lines must be recharged during a single frame of data depends on the content of the data. In particular, whenever a digital 0 is written to a pixel and a digital 1 is written to a pixel in the next row (same column), the column lines must be recharged. For a 1280×720 pixel display, the column lines must be recharged approximately 9 million times for a typical display picture, and can require in excess of 29 million recharges for worst case frames of data. Moreover, because the required number of column line recharges varies depending on the video data, power consumption is not consistent.

In order to improve image quality, different data schemes have been developed. In some cases, original data (e.g., 8-bit) is converted to data having a greater number of bits (e.g., in excess of 60 bits). The increased number of bits greatly increases the number of column line transitions and, therefore, also the power consumption of the display. In addition, the increased number of data bits requires larger memory buffers, which increases the cost of the display and/or driver circuits.

What is needed is a display that uses less power than prior art displays. What is also needed is a display with more consistent power consumption. What is also needed is a display that can achieve the results of driving schemes using an increased number of data bits, but without increasing the size of memory buffers within the display and/or driving circuits.

SUMMARY

The present invention overcomes the problems associated with the prior art by providing a display and display driving method that implement a pixel set/reset scheme. The invention facilitates driving a display according to multi-bit video data, while reducing the number of time the column lines of the display must be recharged during a frame of data.

A display includes a pixel cell including a set terminal, a reset terminal, an output terminal, and a set/reset circuit coupled to receive a set signal via the set terminal and a reset signal via the reset terminal. Responsive to receiving a set signal on the set terminal, the set/reset circuit is operative to assert a first signal on the output terminal and to maintain the first signal on the output terminal until a reset signal is received on the reset terminal. Responsive to receiving a reset signal on the reset terminal, the set/reset circuit is operative to assert a second signal on the output terminal and to maintain the second signal on the output terminal until a set signal is received on the set terminal. The optical output of the pixel depends on when the first signal and the second signal are asserted on the output terminal of the set/reset circuit during a predefined modulation period.

The display additionally includes a set signal line coupled to the set terminal of the pixel cell, a reset line coupled to the reset terminal of the pixel cell, and a logic circuit. The logic circuit has a display data input terminal set coupled to receive display data, which is indicative of an intensity value to be displayed by the pixel. The logic circuit also has a timing data input terminal set coupled to receive timing data, which is indicative of a particular portion of the modulation period. The logic circuit is operative to selectively assert a set signal on the set signal line, a reset signal on the reset signal line, or no signal on either of the set signal line or the reset signal line, depending on the values of the display data and the timing data.

An example display includes a plurality of the pixel cells arranged to form a column of pixel cells in the display. The set terminal of each of the plurality of pixel cells is coupled to the set signal line, and the reset terminal of each of the plurality of pixel cells is coupled to the reset signal line. The display includes a plurality of the columns of pixel cells, each column of pixel cells including a plurality of pixel cells, a set signal line and a reset signal line.

In the example embodiment, the pixel cell additionally includes a pixel electrode and a switch. The switch has a first input coupled to a first voltage supply line, a second input coupled to a second voltage supply line, and a control terminal coupled to the output terminal of the set/reset circuit. Responsive to the first signal being asserted on the output terminal of the set/reset circuit, the switch is operable to couple the first voltage supply line to the pixel electrode. Responsive to the second signal being asserted on the output terminal of the set/reset circuit, the switch is operable to couple the second voltage supply line to the pixel electrode.

The display also includes a driver circuit coupled to provide the display data to the display data input terminal set of the logic circuit. The driver circuit includes a video data input terminal set for receiving video data from a video data source and is operative to generate the display data based on the video data. In one embodiment, the display data is the same as the video data. The video data includes (n) bits, and the modulation period includes $2^n$-1 subintervals. The set signal is a pulse, and the reset signal is a pulse. No more than one pulse is asserted on the set signal terminal of each pixel during each modulation period, and no more than one pulse is asserted on the reset terminal of each the pixel during each modulation period.

In a second embodiment, the video data defines a plurality of intensity values to be displayed by the pixel, and the driver circuit generates display data that has a different format than the video data. In the second embodiment, the driver circuit is operable to define the modulation period during which one of the intensity values is to be displayed by the pixel, and to also define subintervals of the modulation period during which the set/reset circuit is either in a set state or a reset state. The intensity displayed by the pixel during the modulation period corresponds to the number of subintervals of the modulation period during which the set/reset circuit is in a set state. The modulation period includes a first group of subintervals and a second group of subintervals, and the subintervals of the second group having a different duration than the subintervals of the first group. The display data includes a first portion corresponding to the first group of subintervals and a second portion corresponding to the second group of subintervals. The set signal is a pulse, and the reset signal is a pulse. No more than one pulse is asserted on the set terminal of each pixel during each of the first and second groups of subintervals, and no more than one pulse is asserted on the reset terminal of each pixel during each of the first and second groups of subintervals.

In the second embodiment, the display includes a plurality of pixels and a memory buffer. The memory buffer is coupled to receive the display data from the driver circuit and to provide the display data to the logic circuit. The memory buffer has sufficient capacity to hold the first portion of the display data for all of the pixels of the display for one modulation period, and the memory buffer has sufficient capacity to hold the second portion of the display data for all of the pixels of the display for one modulation period. However, the memory buffer has insufficient capacity to hold all of the pixel data for all of the pixels for one modulation period.

A method of modulating a multi-pixel display is also disclosed. The method includes receiving video data and defining a modulation period. The method also includes providing a set signal to each pixel of the display during the modulation period, and providing a reset signal to each pixel of the display during the modulation period. The relative timing of the set signal and the reset signal for each particular pixel depends on the video data and determines the optical output of each particular pixel.

An example method additionally includes dividing the modulation period into a plurality of subintervals and generating display data based on the video data. The method also includes generating timing data associated with the subintervals and providing the set signals and the reset signals to the pixels based on the timing data and the display data.

In an example method, the display data is the same as the video data. The video data includes (n) bits, and the modulation period includes $2^n$-1 subintervals. Providing the set signals includes asserting set pulses on set signal lines coupled to the pixels and providing no more than one set pulse to each pixel during each modulation period. Providing the reset signal includes asserting reset pulses on reset signal lines coupled to the pixels and providing no more than one reset pulse to each pixel during each modulation period.

In a second example method, the step of dividing the modulation period into a plurality of subintervals includes dividing the modulation period into a first group of subintervals and a second group of subintervals. The subintervals of the second group have a different duration than the subintervals of the first group. Providing the set signals includes asserting set pulses on set signal lines coupled to the pixels and providing no more than one set pulse to each pixel during each of the first and second groups of subintervals. Providing the reset signal includes asserting reset pulses on reset signal lines coupled to the pixels and providing no more than one reset pulse to each pixel during each of the first and second subintervals.

In the second example method, the step of generating the display data includes generating a first portion of the display data corresponding to the first group of subintervals and generating a second portion of the display data corresponding to the second group of subintervals. The step of providing the set signals and the reset signals to the pixels based on the timing data and the display data includes providing the set signals and the reset signals to the pixels during the first group of subintervals based on the first portion of the display data. In addition, the step of providing the set signals and the reset signals to the pixels based on the timing data and the display data includes providing the set signals and the reset signals to the pixels during the second group of subintervals based on the second portion of the display data.

In a particular example method, the step of generating the display data includes generating a first binary data word and a second binary data word. The first binary data word has a value indicative of a number of the subintervals of the first group during which an associated pixel should be in a set state. The second binary data word has a value indicative of a number of the subintervals of the second group during which an associated pixel should be in a set state.

The disclosed embodiments provide examples of means for receiving video data and providing set signals and reset signals to the pixels of a display based on the video data.

BRIEF DESCRIPTION OF THE DRAWINGS

The present invention is described with reference to the following drawings, wherein like reference numbers denote substantially similar elements:

FIG. 12A is a logic chart showing the processing of a first portion of the data word of FIG. 7 by a pulse logic unit of the pulse generator of FIG. 10;

FIG. 12B is a logic chart showing the processing of a second portion of the data word of FIG. 7 by the pulse logic unit of the pulse generator of FIG. 10;

DETAILED DESCRIPTION

The present invention overcomes the problems associated with the prior art, by providing a display and driving display method with pixel cells having a set/reset structure and function. In the following description, numerous specific details are set forth (e.g., number of columns and rows in a display, type of display, specific data type, and so on) in order to provide a thorough understanding of the invention. Those skilled in the art will recognize, however, that the invention may be practiced apart from these specific details. In other instances, details of well-known display manufacturing and driving practices (e.g., asynchronous driving schemes) have been omitted, so as not to unnecessarily obscure the present invention.

The invention will be described first with reference to an embodiment for displaying 8-bit video data, in order to simplify the explanation of the basic aspects of the invention. Then, an embodiment of the invention for displaying 8-bit image data using a more complicated modulation scheme will be described. It should be understood, however, that the invention can be applied to systems for displaying image data having any number of bits and/or weighting schemes.

Figure 1:
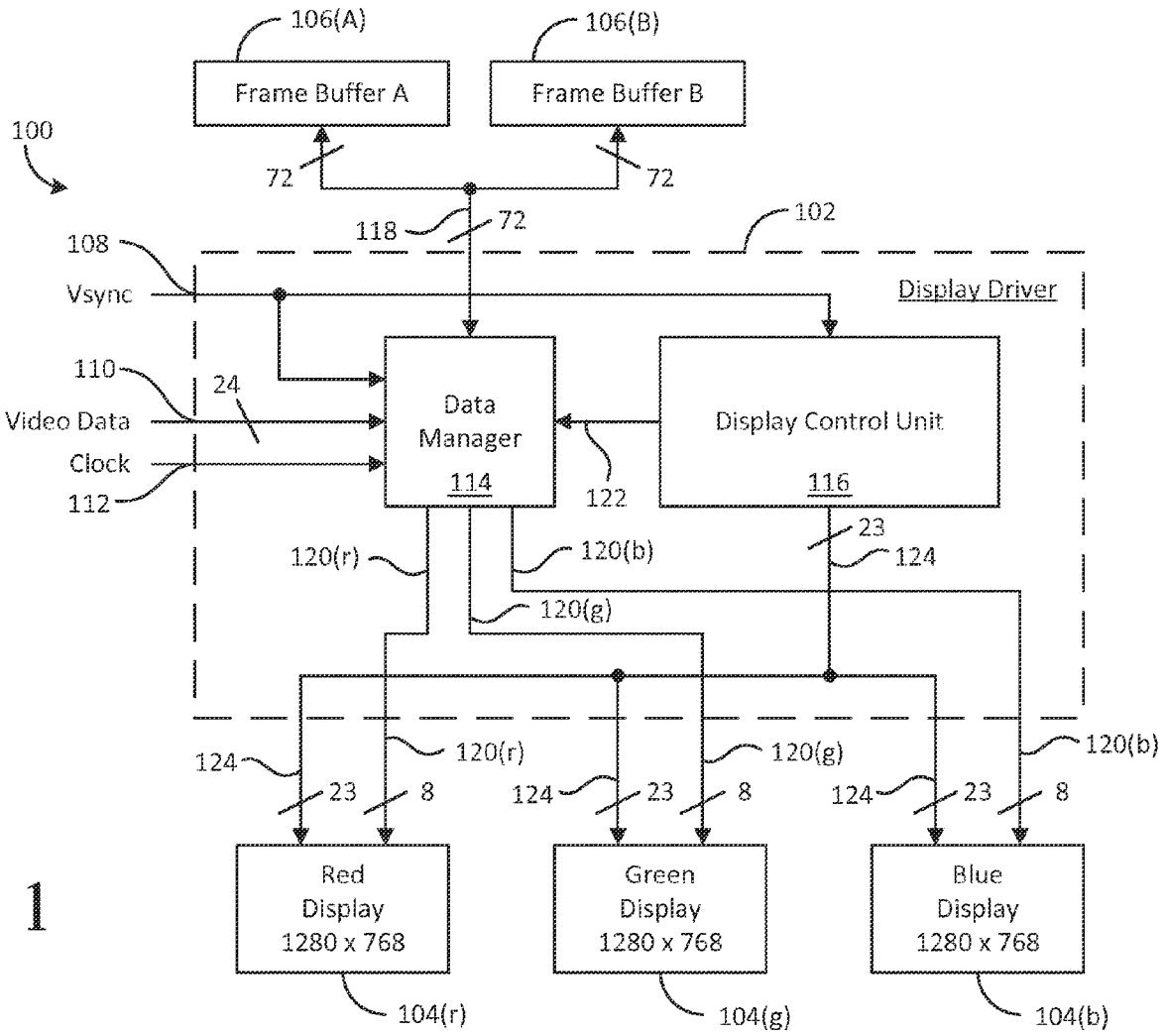
FIG. 1 is a block diagram of a display system according to a first embodiment of the present invention.

FIG. 1 is a block diagram showing a display system 100 according to one embodiment of the present invention. Display system 100 includes a display driver 102, a red display 104(*r*), a green display 104(*g*), a blue display 104(*b*), and a pair of frame buffers 106(A) and 106(B). Each of displays 104(*r, g, b*) contain an array of pixel cells (not shown in FIG. 1) arranged in 1280 columns and 768 rows for displaying an image. Display driver 102 receives a plurality of inputs from a system (e.g., a computer system, television receiver, etc., not shown), including a vertical synchronization (Vsync) signal via input terminal 108, video data via a video data input terminal set 110, and a clock signal via a clock input terminal 112.

Display driver 102 includes a data manager 114 and a display control unit (ICU) 116. Data manager 114 is coupled to Vsync input terminal 108, video data input terminal set 110, and clock input terminal 112. In addition, data manager 114 is coupled to each of frame buffers 106(A) and 106(B) via 72-bit buffer data bus 118. Data manager is also coupled to each display 104(*r, g, b*) via a plurality (eight in the present embodiment) of display data lines 120(*r, g, b*), respectively. Therefore, in the present embodiment bus 118 has three times the bandwidth of display data lines 120(*r, g, b*) combined. Finally, data manager 114 is coupled to a coordination line 122. Display control unit 116 is also coupled to input terminal 108 and to coordination line 122, and to each of displays 104(*r, g, b*) via a plurality (twenty-three in this example embodiment) of display control lines 124(*r, g, b*).

Display driver 102 controls and coordinates the driving process of displays 104(*r, g, b*). Data manager 114 receives video data via video data input terminal set 110, and provides the received video data to one of frame buffers 106(A-B) via buffer data bus 118. In the present embodiment, video data is transferred to frame buffers 506(A-B) 72 bits at a time (i.e., (3) 24-bit data words at a time). Data manager 114 also retrieves video data from one of frame buffers 106(A-B), separates the video data according to color, and provides each color (i.e., red, green, and blue) of video data to the respective display 104(*r, g, b*) via display data lines 120(*r, g, b*). Note that display data lines 120(*r, g, b*) each include 8 bits. Thus, one pixel worth of the 8-bit data can be transferred at one time. It should be understood, however, that a greater number of data lines 120(*r, g, b*) could be provided to reduce the speed and number of transfers required. Data manager 114 utilizes the coordination signals received via coordination line 122 to ensure that the proper data is provided to each of displays 104(*r, b, g*) at the proper time. Finally, data manager 114 utilizes the synchronization signals provided at input terminal 108 and the clock signals received at clock input terminal 112 to coordinate the routing of video data between the various components of display driving system 100.

Data manager 114 reads and writes data from and to frame buffers 106(A and B) in alternating fashion. In particular, data manager 114 reads data from one of the frame buffers (e.g., frame buffer 106(A)) and provides the data to displays 104(*r, g, b*), while data manager writes the next frame of data to the other frame buffer (e.g., frame buffer 106(B)). After the first frame of data is written from frame buffer 106(A) to displays 104(*r, g, b*), then data manager 114 begins providing the second frame of data from frame buffer 106(B) to displays 104(*r, g, b*), while writing the new data being received into frame buffer 106(A). This alternating process continues as data streams into display driver 102, with data being written into one of frame buffers 106 while data is read from the other of frame buffers 106.

Data manager can also convert the video data to some other format, depending on the driving scheme being implemented in display system 100. For example, the 24 bit RGB data (8 binary weighted bits per color) can be converted to compound data (e.g., data words including a set of binary weighted bits and a set arbitrarily weighted bits) having a greater number of bits. The converted/reformatted data is referred to herein as display data (i.e., data transferred to display 104). In this particular embodiment, however, no conversion is necessary, and so the video data and the display data are the same.

Display control unit 116 controls the modulation (i.e., set and reset) of the individual pixel cells of each display 104(*r, g, b*) to display a respective colored image. Displays 104(*r, g, b*) are arranged such that individual displayed colored images are superimposed to form a full color image. Display control unit 116 supplies various control signals to each of displays 104(*r, g, b*) via common display control lines 124. Display control unit 116 also provides coordination signals to data manager 114 via coordination line 122, so that display control unit 116 and data manager 114 remain synchronized, and the integrity of the image produced by displays 104(*r, g, b*) is maintained. Finally, display control unit 116 receives synchronization signals from input terminal 108, such that display control unit 116 and data manager 114 are resynchronized with each frame of data.

Responsive to the video data received from data manager 114 and to the control signals received from display control unit 116, displays 104(*r, g, b*) modulate each pixel of their respective displays according to the video data associated with that pixel. Each pixel of displays 104(*r, g, b*) is modulated with a single pulse, rather than a conventional pulse width modulation scheme, by generating set and reset signals based on the video data.

Figure 2:
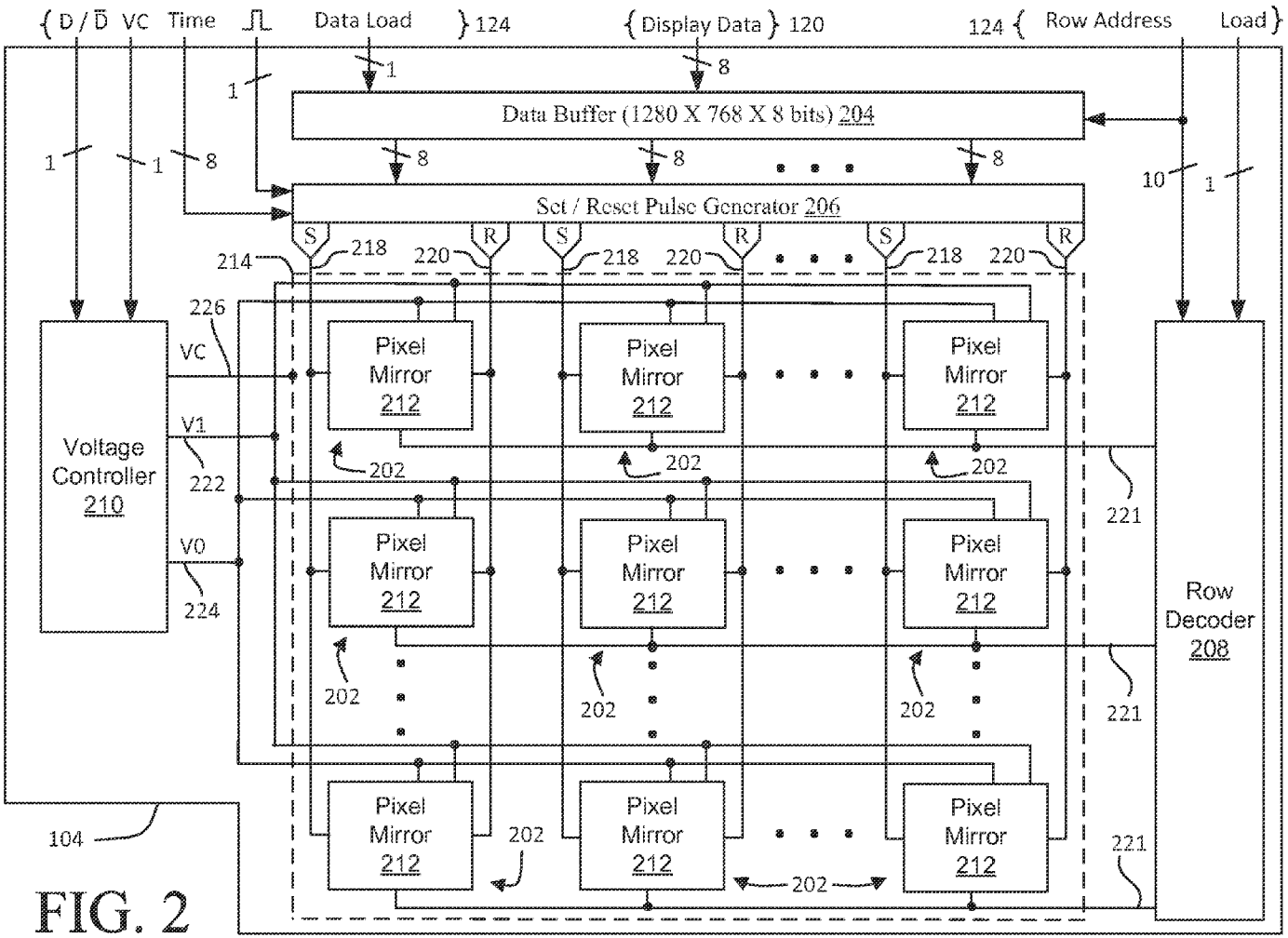
FIG. 2 is a block diagram of a display device of the display system of FIG. 1.

FIG. 2 is a block diagram of one of displays 104 of display system 100 (FIG. 1). Display 104 includes a plurality of pixel cells 202 arranged in columns and rows, a data buffer 204, a set/reset pulse generator 206, a row decoder 208, and a voltage controller 210. In this example, display 104 is a liquid crystal on silicon (LCOS) device. Each pixel cell 202 includes a reflective pixel mirror 212, which overlies the circuitry (not visible in FIG. 2) of the pixel cell. A liquid crystal layer (not shown) overlies pixel mirrors 212 and is covered by a transparent common electrode 214. The liquid crystal layer rotates the polarization of light passing through the liquid crystal by an amount dependent on the voltage between pixel mirrors 212 and common electrode 214. Polarizers (not shown) can then be used to display light and dark pixels depending on the polarization rotation caused by each pixel cell 202.

Display 104 operates in response to control signals and data provided by display driver 102 (FIG. 1). Data buffer 204 loads data received via display data lines 120 in response to a data load signal received via one of display control lines 124. In this example embodiment, data buffer 204 has a capacity of (1280×768×8) bits, which enables data buffer 204 to store one complete frame of display data (i.e., 8 bits for each pixel of a display with 1280 columns and 768 rows). In response to a row address provided to data buffer 204 and to row decoder 208, data buffer 204 provides the corresponding row of display data (8-bits per pixel) to set/reset pulse generator 206.

Set/reset pulse generator 206 compares the received display data to timing data received via display control lines 124 and, depending on the comparison, selectively communicates a pulse received via another one of display control lines 124 to an associated one of set signal lines 218, an associated one of reset signal lines 220, or neither one of set signal lines 218 and reset signal lines 220. Row decoder 208 decodes the row address provided via display control lines 124 and asserts an enable signal on a corresponding one of row enable lines 221. The enable signal asserted on one of row lines 220 enables each pixel cell 202 of that row to receive a pulse (if present) being asserted on the corresponding set signal line 218 or rest line 220.

Set signal lines 218 and reset signal lines 220 replace the data lines of prior displays. Each set signal line 218 and reset signal line 220 is coupled to an associated column of pixel cells 202. However, rather than writing data bits to the pixel cells 202, the pixel cells 202 are set (e.g., turned on) via a pulse on set signal line 218 and reset (e.g., turned off) via a pulse on reset signal line 220. The grayscale level displayed by a particular pixel depends on the portion of the modulation period that the particular pixel is in a set state (e.g., turned on). The set/reset driving scheme of the present invention greatly decreases the number of times that the column lines (set signal lines 218 and reset signal lines 220) must be recharged during each frame of data, especially as compared to the data lines of prior displays. Indeed, in this example embodiment only one set pulse and one reset pulse need to be provided to each pixel during the modulation period for a single frame of data. The decrease in the number of times that the set signal lines 218 and the reset signal lines 202 must be recharged results in a significant decrease in power consumption.

Voltage controller 210, responsive to a debiasing signal (D/D-bar) and a VC reference voltage) provides a means of debiasing display 104, thereby preventing damage of the LCOS device due to ionic migration within the liquid crystal layer. In particular, voltage controller 210 controls the voltage provided to common electrode 214 via VC line 226, the "on" pixel voltage provided to pixel cells 202 via V1 line 222, and the "off" pixel voltage supplied to pixel cells 202 via V0 line 224. By changing the voltages on V1 line 222 and V0 line 224, voltage controller can maintain the magnitude, but reverse the direction, of the voltages between the pixel mirrors 212 and the common electrode 214. For example, If VC is at 0 Volts and V1 is at 3.5 Volts, changing the voltage on V1 to −3.5 volts will not change the optical output of the pixel cell 202, but will help to debias the liquid crystal layer above the pixel mirror 212. Optimal debiasing occurs when the root-mean-square (RMS) voltage across the liquid crystal approaches 0 over time.

Figure 3:
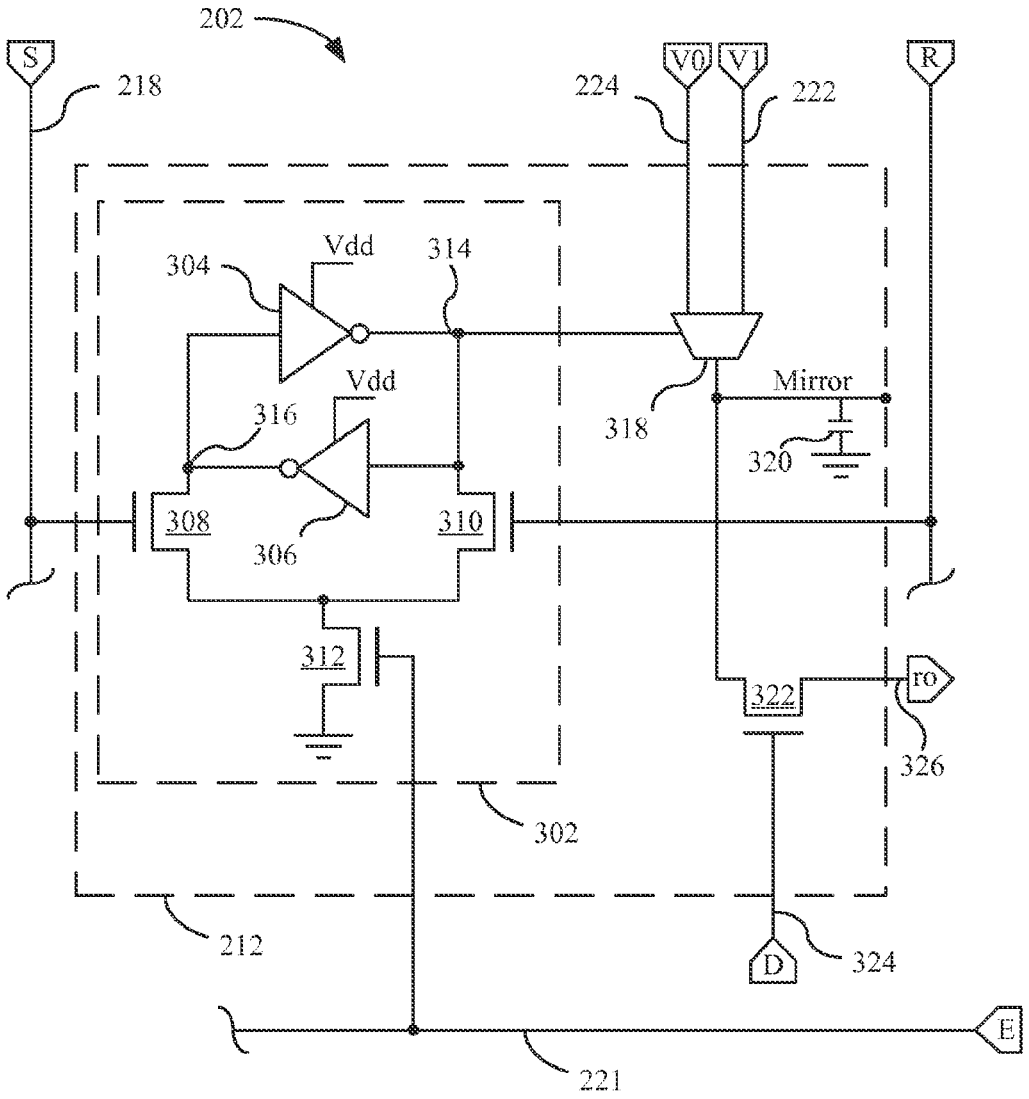
FIG. 3 is a simplified circuit diagram of a pixel cell of the display of FIG. 2.

FIG. 3 is a simplified circuit diagram of a pixel cell 202 of display 104. Pixel cell 202 includes a set/reset circuit 302, which in this example embodiment includes a first inverter 304, a second inverter 306, a set gate 308, a reset gate 310, and an enable gate 312. The output of first inverter 304 is coupled to the input of second inverter 306 at a node 314, which provides the output of set/reset circuit 302. The output of second inverter 306 is coupled to the input of first inverter 304 at a node 316. Node 314 is coupled to ground through reset gate 310 and enable gate 312, in series. Similarly, node 316 is coupled to ground through set gate 308 and enable gate 312, in series.

Set/reset circuit 302 is set and reset as follows. When enable gate 312 is in a nonconducting state, set/reset circuit 302 maintains its current state (set or reset) regardless of the assertion of set signals on set signal line 218 or reset signals on reset signal line 220. Set/reset circuit 302 can only be set/reset when an enable signal on row enable line 221 brings enable gate 312 into a conducting state.

When enable gate 312 is in a conducting state, a pulse on set signal line 218 sets set/reset circuit 302. The pulse on set signal line 218 brings set gate 308 into a conducting state and pulls node 316 low. In response to the low signal on node 316, first inverter 304 asserts a high signal on node 314, which is the output of set/reset circuit 302. The high signal on node 314 also causes second inverter 306 to assert a low signal on node 316 and maintains the low signal on node 316 after the set pulse on set signal line 218 has ended and set gate 308 is no longer in a conducting state. In the set state, the output (node 314) of set/reset circuit 302 remains high.

When enable gate 312 is in a conducting state, a pulse on reset signal line 220 resets set/reset circuit 302. The pulse on reset signal line 220 brings reset gate 310 into a conducting state and pulls node 314 low. In response to the low signal on node 314, second inverter 306 asserts a high signal on node 316. The high signal on node 316 also causes first inverter 304 to assert a low signal on node 314 and maintains the low signal on node 314 after the reset pulse on reset signal line 220 has ended and reset gate 310 is no longer in a conducting state. In the reset state, the output (node 314) of set/reset circuit 302 remains low.

Pixel cell 202 also includes a multiplexer 318. Multiplexer 318 has a first input coupled to V1 voltage supply line 222, a second input coupled to V0 voltage supply line 224, a control input coupled to node 314 (the output of set/reset circuit 302), and an output coupled to pixel mirror 212 and a capacitor 320. Responsive to a low signal on node 314, multiplexer 318 couples V0 voltage supply 224 line to pixel mirror 212 and capacitor 320, placing pixel 202 in an "off" state. Responsive to a high signal on node 314, multiplexer 318 couples V1 voltage supply line 222 to pixel mirror 212 and capacitor 320, placing pixel cell 202 in an "on" state. Thus, when pixel cell 202 is in a reset state, pixel cell 202 is off, and when pixel cell 202 is in set state, pixel cell 202 is on. Although the output of set/reset circuit 302 could be coupled directly to pixel mirror 212, the use of multiplexer 318 facilitates debiasing of the liquid crystal display, as described above.

Pixel cell 202 also includes a data read gate 322. Data read gate 322 facilitates the reading of data being asserted on pixel mirror 212 for diagnostic purposes. A data read signal asserted on data read input 324 brings data read gate 322 into a conducting state, thereby providing the voltage being asserted on pixel mirror 212 to read out line 326. The diagnostic pixel read feature of pixel cell 202 is not particularly germane to the remainder of the invention. Therefore, data read input 324 and read out line 326 are omitted from the remainder of the drawings, so as not to unnecessarily complicate those drawings.

Figure 3A:
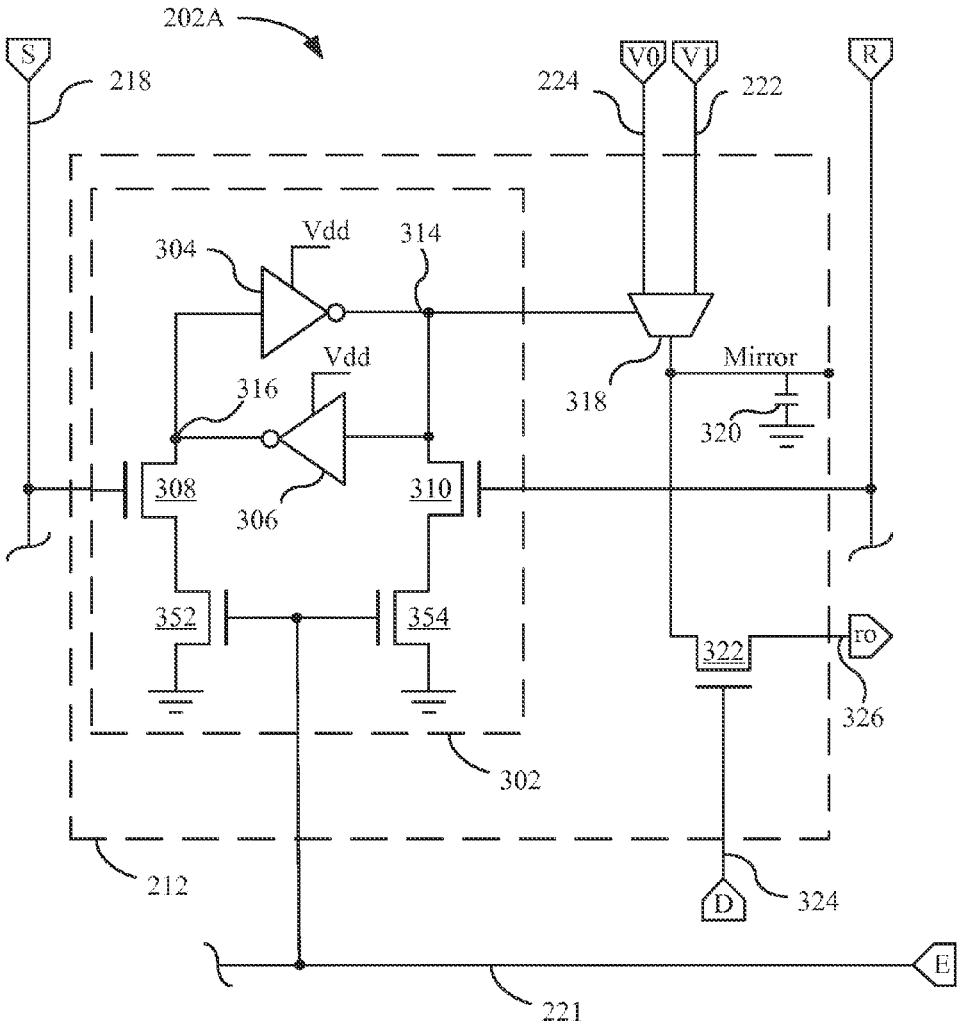
FIG. 3A is a simplified circuit diagram of an alternate pixel cell.

FIG. 3A is a simplified circuit diagram of an alternate pixel cell 202A. Alternate pixel cell 202A is identical to pixel cell 202 of FIG. 3, except that enable gate 312 is replaced with a pair of enable gates 352 and 354. Enable gates 352 and 354 function similarly to enable gate 312, but the use of two separate enable gates provides performance enhancement at the expense of additional integrated devices.

Figure 4:
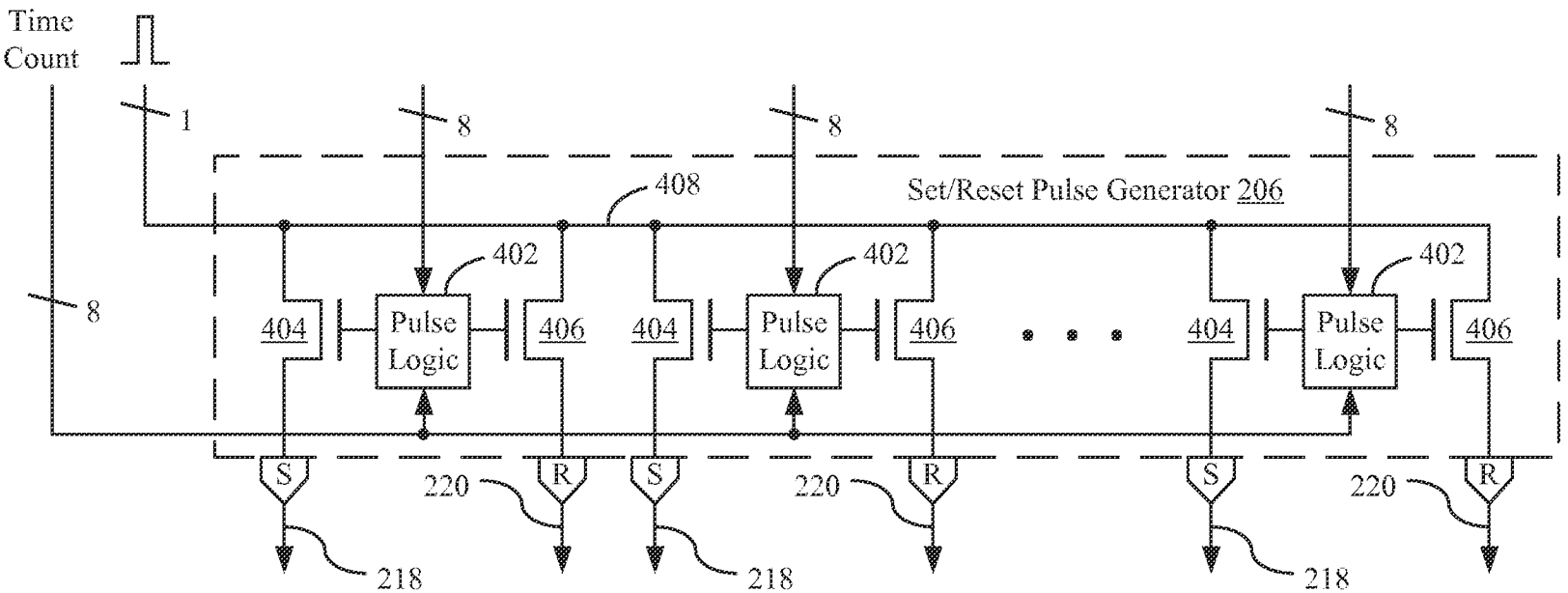
FIG. 4 is a simplified circuit diagram of a pulse generator of the display of FIG. 2.

FIG. 4 is a simplified circuit diagram of set/reset pulse generator 206. Set/reset pulse generator 206 includes pulse logic 402, a set gate 404, and a reset gate 406 for each column of pixel cells 202 of display 104. Pulses are received via a pulse line 408 from display control unit 116 (FIG. 1). Each set gate 404 selectively couples pulse line 408 to a respective one of set signal lines 218. Similarly, each reset gate 406 selectively couples pulse line 408 to a respective one of reset signal lines 220. Pulse logic 402 has a first output coupled to the control gate of set gate 404 and a second output coupled to the control gate of reset gate 406.

Pulse logic 402 receives the 8-bit display data and the 8-bit time count from display driver 102, and determines whether a set signal or a reset signal should be communicated to the associated pixel 202. The display data is indicative of the intensity to be displayed by the pixel cell 202 during a predefined modulation period, and the time count is indicative of a particular subinterval of the modulation period. If the comparison of the time value and the display data indicates that a set signal should be provided to the pixel cell 202, then pulse logic 402 asserts a voltage onto the control gate of set gate 404, so that set gate 404 will be in a conducting state, and the pulse asserted on pulse line 408 will be communicated to set signal line 218. If the comparison of the time value and the display data indicates that a reset signal should be provided to the pixel cell 202, then pulse logic 402 asserts a voltage onto the control gate of reset gate 406, so that reset gate 406 will be in a conducting state, and the pulse asserted on pulse line 408 will be communicated to reset signal line 220. If the comparison of the time value and the display data indicates that neither a set signal nor a reset signal should be provided to the pixel cell 202, then pulse logic 402 maintains a voltage on the control gates of set gate 404 and reset gate 406, so that set gate 404 and reset gate 406 remain in a nonconducting state and the pulse asserted on pulse line 408 will not be communicated to set signal line 218 or reset signal line 220.

In general, pulse logic 402 communicates pulses to set signal line 218 and reset signal line 220 to turn the pixel cells on (set) and off (reset) during particular subintervals of the modulation period, so that the optical output of a particular pixel cell 202 corresponds to the intensity value of the display data for that particular pixel cell 202. The number and timing of set and reset pulses provided to pixel cells 202 depend on the modulation period (the time during which an intensity value is displayed by a pixel cell) and how that modulation period is subdivided.

Figure 5:
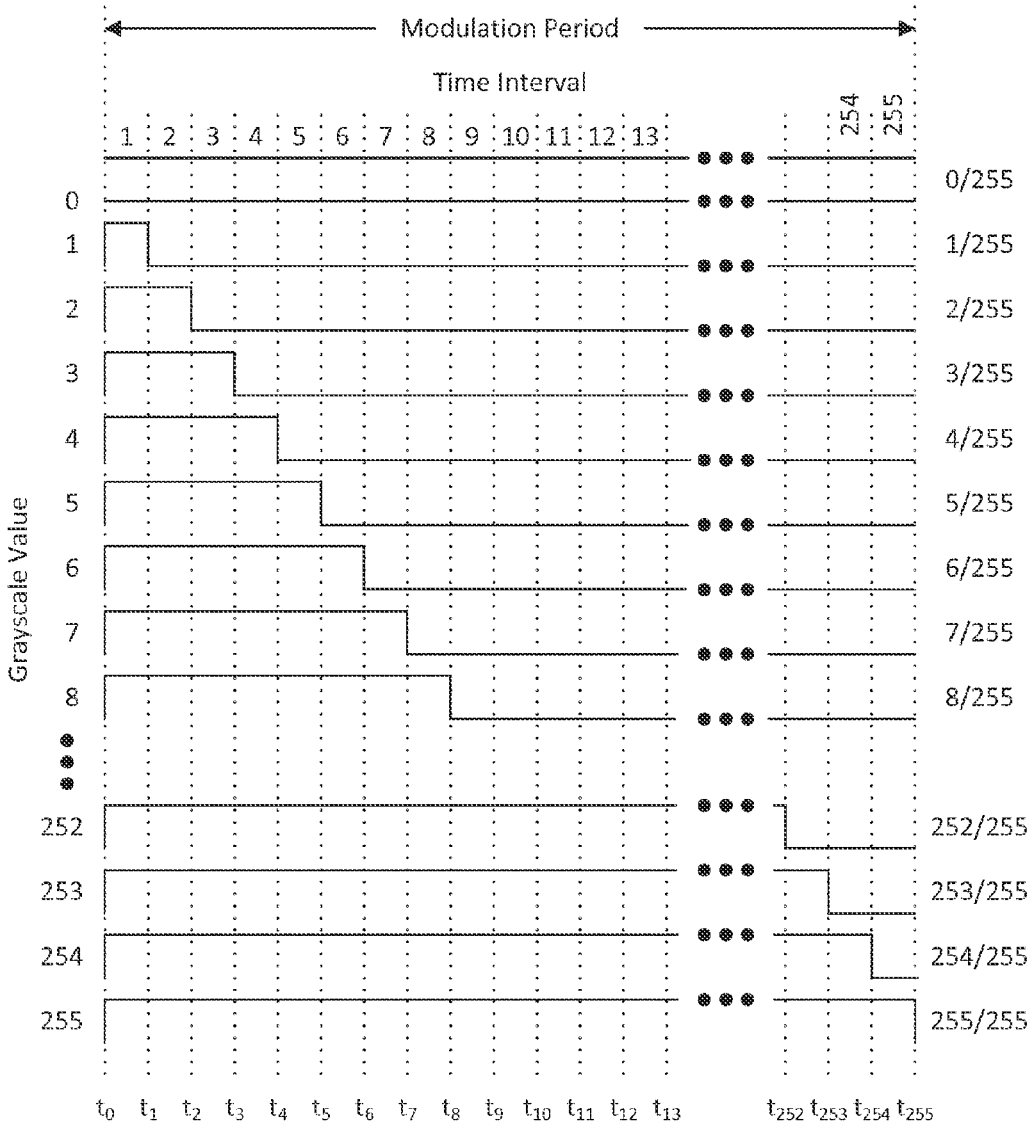
FIG. 5 is a timing diagram of pixel modulation to achieve 255 grayscale levels.

FIG. 5 is a chart showing how the modulation period is subdivided in the presently described embodiment. The modulation period is divided into 255 subintervals, which facilitates the display of 256 discrete grayscale levels as defined by the 8-bit display data. The time values ($t_{0\text{-}255}$) correspond to the number of the subinterval immediately preceding the associated time. For example, time ($t_3$) occurs between subinterval 3 and subinterval 4. To achieve the grayscale value of 0, the pixel 202 is reset at time ($t_0$) and not set for the duration of the modulation period. As a result, pixel 202 is on for 0/255 subintervals, thus producing an optical output corresponding to a 0 grayscale value.

To achieve any of the grayscale values from 1-255, pixel 202 is set at time ($t_0$) and reset at a time corresponding to the intensity value of the display data. For example, if the 8-bit display data indicates a value of 7, then pixel cell 202 is set at time ($t_0$) and reset at time ($t_7$). As another example, if the 8-bit display data indicates a value of 253, then pixel cell 202 is set at time ($t_0$) and reset at time ($t_{253}$). In general, pixel cell 202 is reset after it has been set for a number of subintervals corresponding to the intensity value of the display data.

Figure 6:
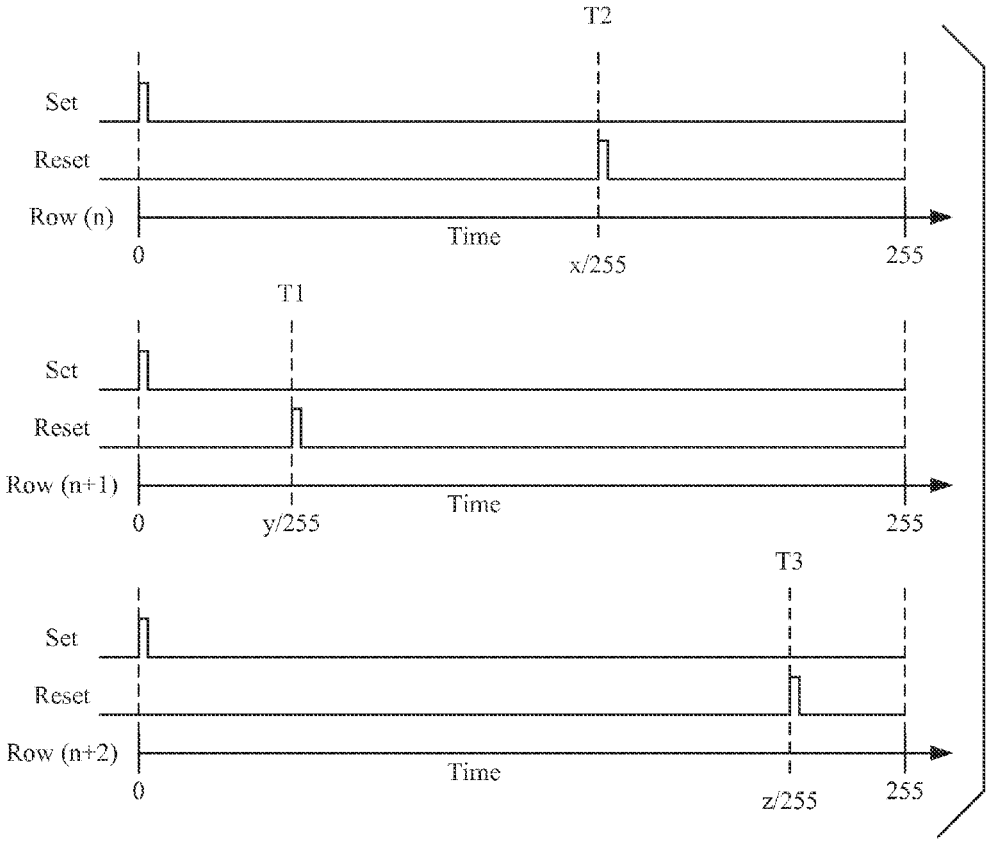
FIG. 6 is a timing diagram of signals applied to set and reset lines of the display of FIG. 2.

FIG. 6 is a timing diagram showing the application of set and reset signals to the set signal line 218 and reset signal line 220 of the column of pixel cells 202. In the diagram of FIG. 6, 3 different pixel cells in the same column are being set and reset. The first pixel cell 202 is located in Row (n), the second pixel cell 202 is located in Row (n+1), and the third pixel cell 202 is located in Row (n+2).

The diagram of FIG. 6 illustrates how the set signal line 218 and the reset signal line 220 of the present embodiment require far fewer voltage transitions (charge, discharge, and recharge) than the column data lines of prior displays. Each pixel cell 202 requires only 1 set pulse and 1 reset pulse to display the particular grayscale value, as compared to writing 8 separate bits of data to each pixel cell of prior displays. The comparison is even more favorable when display data having a greater number of bits is used.

Furthermore, no additional transitions of set signal line 218 and reset signal line 220 are required due to different intensity values being displayed by pixel cells 202 in an adjacent row. In the present embodiment, the required number of transitions of set signal line 218 and reset signal line 220 per modulation period is fixed (one set pulse and one reset pulse per pixel cell 202) and independent of the particular intensity values displayed by adjacent pixels.

In prior displays additional transitions of the column data lines would be required. In the example of FIG. 6, a value of (x) is asserted on pixel cell 202 of Row (n), a value of (y) is asserted on pixel cell 202 of Row (n+1), and a value of (z) is asserted on pixel cell 202 of Row (n+2). Intensity value (y) is less than intensity value (x), which is less than intensity value (z). During the time period between T1 and T2, pixel 202 of Row (n+1) will be in an off state (bit value=0), but the pixel cells 202 of Row (n) and Row (n+2) will be in an on state (bit value=1). Therefore, in a prior display, the column data lines would have to transition from writing a (1) to the pixel cell 202 of Row (n), to then writing a (0) to pixel cell 202 of Row (n+1), and then again to writing a (1) to pixel cell 202 of Row (n+2). These transitions would be repeated for each bit of data written to pixel cells 202 between times T1 and T2. Similarly, additional transitions would be required for each data bit between time T2 and Time T3, because pixel cell 202 of Row (n+1) is in an off state, but pixel cell 202 of Row (n+2) is in an on state.

Figure 7:
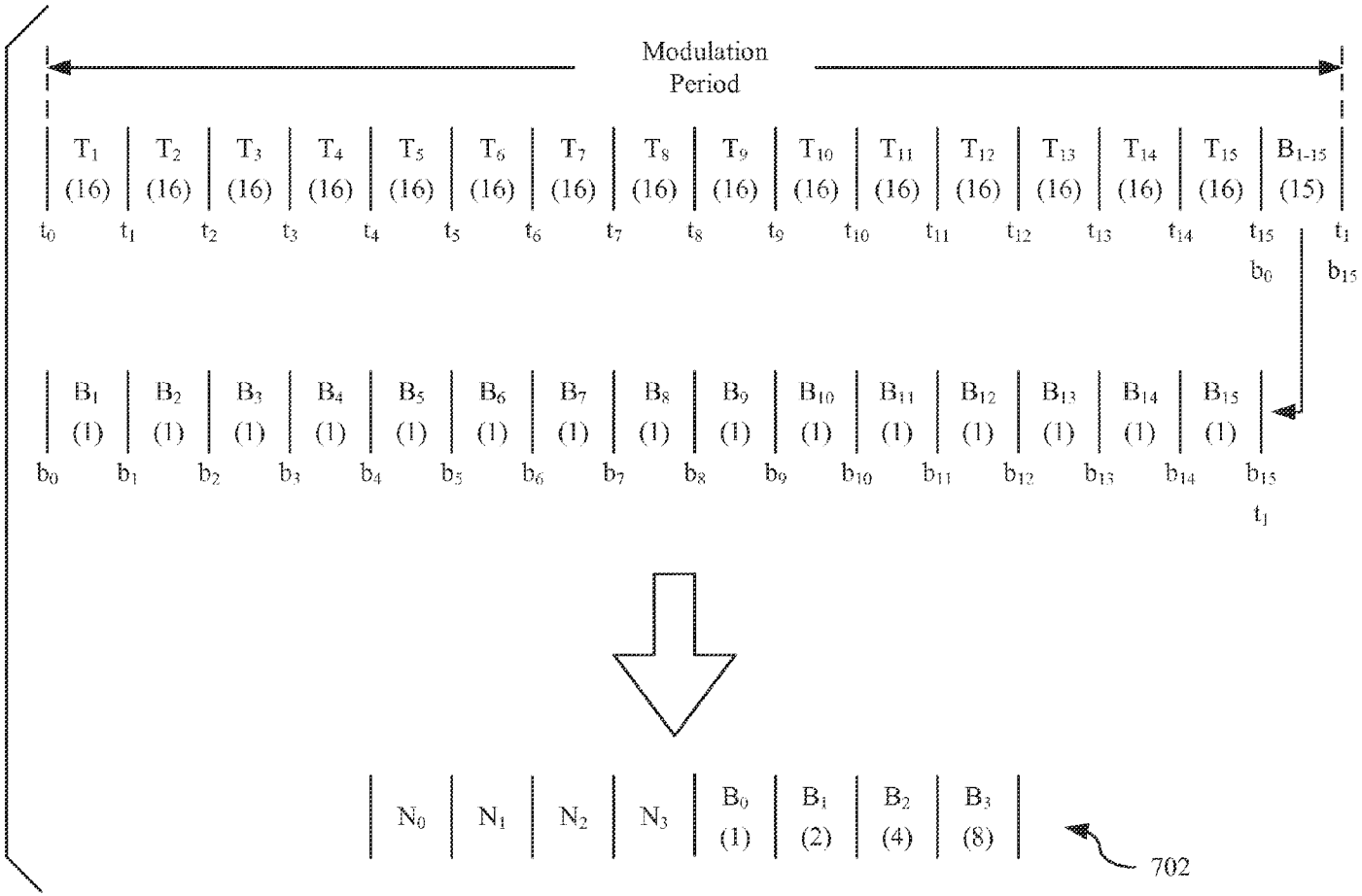
FIG. 7 shows a data representation of a modulation scheme implemented in an alternate embodiment of the present invention.

FIG. 7 shows a data representation of a modulation scheme implemented in an alternate embodiment of the present invention. According to this embodiment, the modulation period is divided into 30 subintervals. The 30 subintervals are divided into two groups. The 15 subintervals of the first group ($T_{1-15}$) each have a duration of 16 time units. The 15 subintervals of the second group ($B_{1-15}$) each have a duration of 1 time unit. The entire modulation period, therefore, includes 255 time units and is capable of representing 256 discrete grayscale values (including 0).

Intensity values displayed using the depicted modulation period are represented by an 8-bit data word 702. Data word 702 includes one group of bits for each group of subintervals in the modulation period. In this example, data word 702 includes 4 N bits corresponding to the first group of $T_{1-15}$ subintervals and 4 B bits corresponding to the second group of $B_{1-15}$ subintervals. The binary value of the 4 N bits indicate the number of T subintervals during which a pixel cell 202 should be in a set state (on), and the binary value of the 4 B bits indicate the number of B subintervals during which the pixel cell 202 should be in a reset state (off). As will be explained below with reference to a second embodiment, this novel data structure reduces the required capacity of the memory buffer in the display device.

Figure 8:
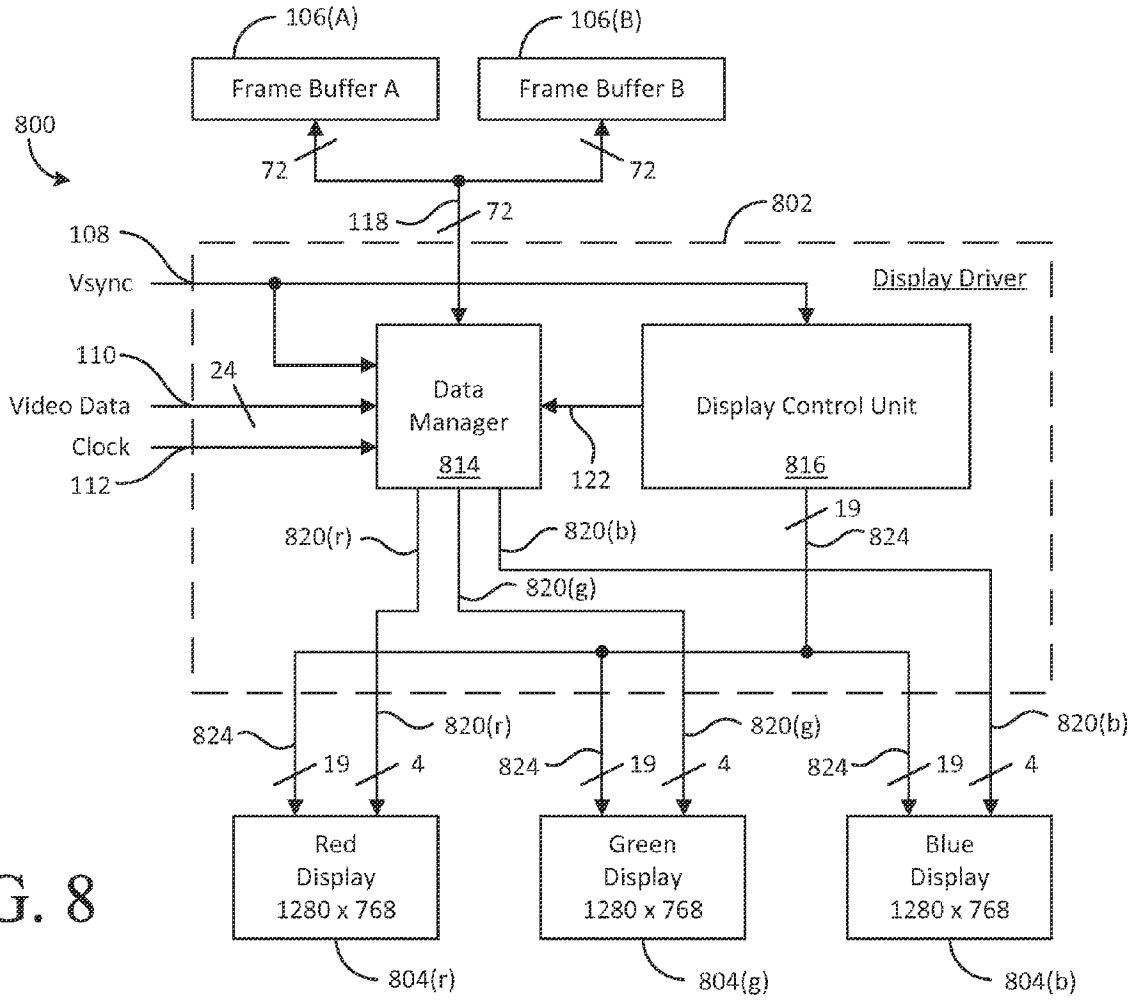
FIG. 8 is a block diagram showing an alternate display system capable of implementing the modulation scheme of FIG. 7.

FIG. 8 is a block diagram of an alternate display system 800. Display system 800 is similar to display system 100, except for modifications to implement the modulation scheme of FIG. 7. Display system 800 includes a display driver 802 and displays 804(*r, g, b*), interconnected via data lines 820 and display control lines 824. In contrast to the prior embodiment, data lines 820 include 4 lines instead of 8, because only half (4-bits) of data word 702 are provided to displays 804 at a time. Data lines 820 can include more lines to facilitate data transfer for more than one pixel cell 202 at a time (e.g., 16 lines to transfer 4 bits for each of 4 pixel cells 202), but 4 lines are shown for clearer explanation. In addition, display control lines 824 include 19 lines, which is 4 fewer than the previously described embodiment, because fewer bits are required to communicate the timing value in the present embodiment, which will be described in greater detail below.

As in the prior embodiment, data manager 814 receives the 24-bit RGB video data (8 bits per color) via video data input terminal set 110. However, prior to transferring the video data to frame buffers 106(A, B), data manger 814 converts each 8-bit intensity value to display data in the format of data word 702 of FIG. 7 having the same intensity value. Then, responsive to control signals from display control unit 816, received via coordination line 122, data manager 814 provides either the 4 N bits or the 4 B bits of an entire frame of display data to displays 804.

Display control unit 816 provides timing and control data/signals to displays 804 to set and reset the pixel cells 202 of displays 804 according to display data provided by data manager 814. These timing and control signals are explained in greater detail with reference to subsequent drawings, showing displays 804 in greater detail.

Figure 9:
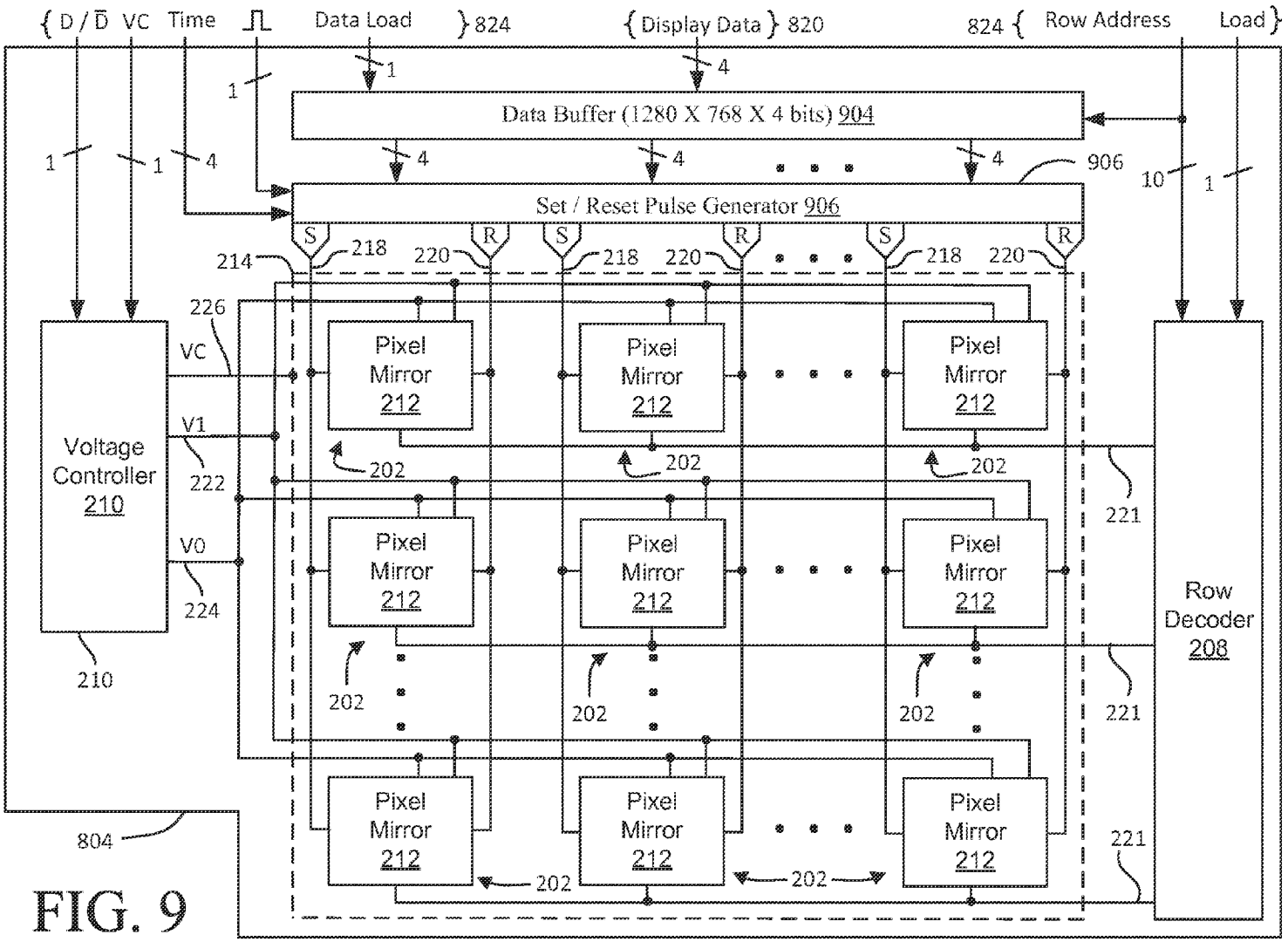
FIG. 9 is a block diagram of a display device of the display system of FIG. 8.

FIG. 9 is a block diagram of a display device 804 of the display system of FIG. 8. Display 804 is similar to display 104, except for data buffer 904 and set/reset pulse generator 906, which are modified to implement the modulation scheme of FIG. 7. In particular, data buffer 904 only requires half the capacity of data buffer 204 (FIG. 2), because data buffer only stores either a frame of N bits or a frame of B bits of data word 702 at one time. In addition, set/reset pulse generator 906 receives and operates on only 4 bits (either the 4 N bits or the 4 b bits) per column at a time. The reduced size of data buffer 904, as compared to data buffer 204, provides a significant savings in size and cost. Set/reset pulse generator is also smaller, and therefore less expensive, than set/reset pulse generator 206 (FIG. 2). At least in part due to the modulation scheme of FIG. 7, the reduced size and cost of data buffer 904 and set/reset pulse generator 906 requires only one extra set pulse and one extra reset pulse per pixel cell 202 per frame of data.

Figure 10:
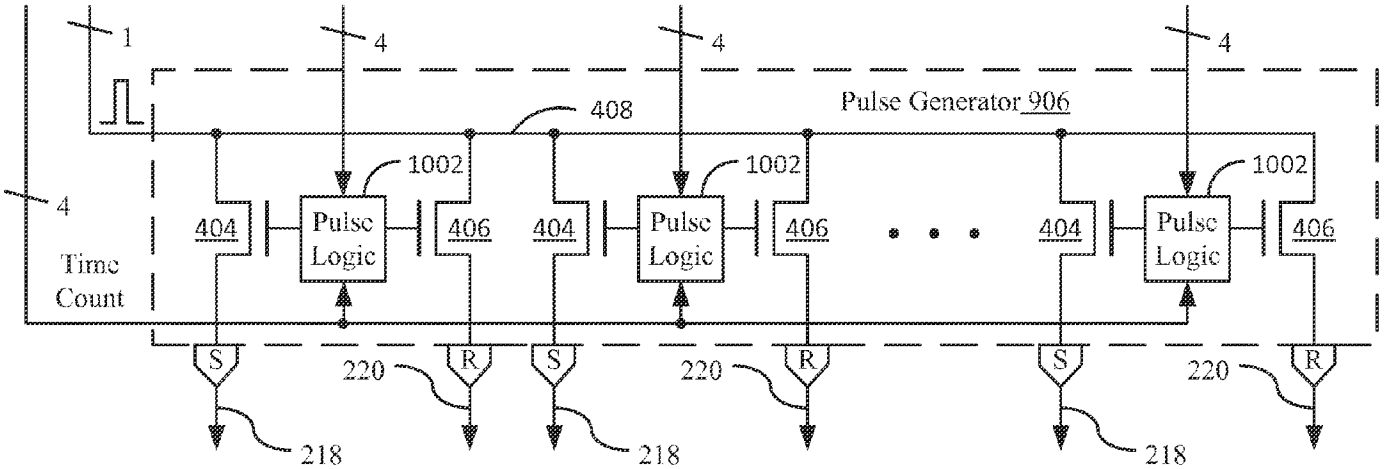
FIG. 10 is a simplified circuit diagram of a pulse generator of the display of FIG. 9.

FIG. 10 is a simplified circuit diagram of set/reset pulse generator 906 of display 804. Se/reset pulse generator 906 is similar to set/reset pulse generator 206, except that set/reset pulse generator 906 includes 4-bit logic 1002, as opposed to the 8-bit logic 402 of set/reset pulse generator 206 (FIG. 2). Pulse logic 1002 receives 4 bits of display data (either the 4 N bits or the 4 B bits) from data buffer 904 and a 4 bit time count from display control unit 816 (FIG. 8). If the comparison of the 4 bit time value and the 4 bit display data indicates that a set signal should be provided to the pixel cell 202, then pulse logic 1002 asserts a voltage onto the control gate of set gate 404, so that set gate 404 will be in a conducting state, and the pulse asserted on pulse line 408 will be communicated to set signal line 218. If the comparison of the time value and the display data indicates that a reset signal should be provided to the pixel cell 202, then pulse logic 1002 asserts a voltage onto the control gate of reset gate 406, so that reset gate 406 will be in a conducting state, and the pulse asserted on pulse line 408 will be communicated to reset signal line 220. If the comparison of the time value and the display data indicates that neither a set signal nor a reset signal should be provided to the pixel cell 202, then pulse logic 1002 maintains a voltage on the control gates of set gate 404 and reset gate 406, so that set gate 404 and reset gate 406 remain in a nonconducting state, and the pulse asserted on pulse line 408 will not be communicated to set signal line 218 or reset signal line 220.

Figure 11:
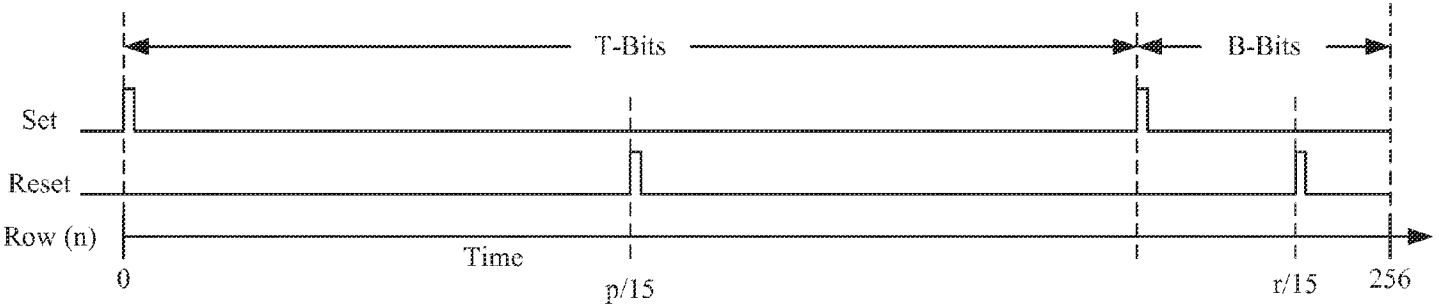
FIG. 11 is a timing diagram of signals applied to set and reset lines of FIG. 9.

FIG. 11 is a timing diagram of signals applied to an example set signal line 218 and reset signal line 220 of display 804 (FIG. 9). In the example of FIG. 11, the display data includes 4 T bits that have a value of (p) and 4 B bits that have a value of (r). The value (p) indicates the number of subintervals $T_1$-$T_{15}$ during which an associated pixel 202 should be in an "on" state, and the value (r) indicates the number of subintervals $B_1$-$B_{15}$ during which pixel 202 should be in an "off" state. At each time $t_0$-$t_{15}$, pulse logic 1002 compares the 4 N bits of display data to the time count. When the value of the time count is equal to 0 (i.e., $t_0$), pulse logic 1002 causes a pulse on pulse line 408 to be communicated to set signal line 218 via gate 404, unless the value (p) is equal to zero. If the value (p) is equal to zero, then pulse logic 1002 does not cause a pulse to be communicated to set signal line 218. At subsequent times ($t_1$-$t_{15}$), pulse logic 1002 compares the value (p) of the 4 N bits of display data to the time count and, causes a pulse on pulse line 408 to be communicated to reset signal line 220 when the count value is equal to the value (p) of the N bits (i.e., at time $t_p$). Otherwise, pulse logic 1002 causes gates 404 and 406 to block transmission of the pulse on pulse line 408 to set signal line 218 and reset signal line 220. As shown in the timing diagram of FIG. 11, a pulse is communicated to set signal line 218 at time $t_0$, and a reset pulse is communicated to reset signal line 220 at time $t_p$. These are the only pulses communicated to the particular pixel 202 during the T subintervals of the modulation period (FIG. 7).

Next, at each time $b_0$-$b_{15}$, pulse logic 1002 compares the 4 B bits of display data to the time count. When the value of the time count is equal to 0 (i.e., $t_0$), pulse logic 1002 causes a pulse on pulse line 408 to be communicated to set signal line 218 via gate 404, unless the value (r) is equal to zero. If the value (r) is equal to zero, then pulse logic 1002 does not cause a pulse to be communicated to set signal line 218. At subsequent times ($b_1$-$b_{15}$), pulse logic 1002 compares the value of the 4 B bits of display data to the time count and, causes a pulse on pulse line 408 to be communicated to reset signal line 220 when the count value is equal to the value (r) of the B bits (i.e., at time $t_r$). Otherwise, pulse logic 1002 causes gates 404 and 406 to block transmission of the pulse on pulse line 408 to set signal line 218 and reset signal line 220. As shown in the timing diagram of FIG. 11, a pulse is communicated to set signal line 218 at time $b_0$, and a reset pulse is communicated to reset signal line 220 at time $b_r$. These are the only pulses communicated to the particular pixel 202 during the B subintervals of the modulation period (FIG. 7).

FIG. 12A is a logic chart showing the logic for processing the first portion (4 N bits) of the data word of FIG. 7 by pulse logic 1002 (FIG. 10). For each value of the 4 N bits, a row of the logic chart indicates the time at which a set signal is communicated to set signal line 218 and a reset signal is communicated to reset signal line 220. For example, for the value 0011 (3), pulse logic 1002 enables the set pulse at time $t_0$ and the reset pulse at time $t_3$. As another example, for the value 1101 (13), pulse logic 1002 enables the set pulse at time $t_0$ and the reset pulse at time $t_{13}$. For each value of the N bits shown in FIG. 12A (except 0000), the set pulse is enabled at time $t_0$, and the reset pulse is enabled when the time value is equal to the value of the 4 N bits.

FIG. 12B is a logic chart showing the logic for processing the second portion (4 B bits) of the data word of FIG. 7 by pulse logic 1002 (FIG. 10). For each value of the 4 B bits, a row of the logic chart indicates the time at which a set signal is communicated to set signal line 218 and a reset signal is communicated to reset signal line 220. For example, for the value 0111 (7), pulse logic 1002 enables the set pulse at time $t_0$ and the reset pulse at time $t_7$. As another example, for the value 1100 (12), pulse logic 1002 enables the set pulse at time $t_0$ and the reset pulse at time $t_{13}$. For each value of the B bits shown in FIG. 12B (except 0000), the set pulse is enabled at time $t_0$, and the reset pulse is enabled when the time value is equal to the value of the 4 B bits.

Figure 13:
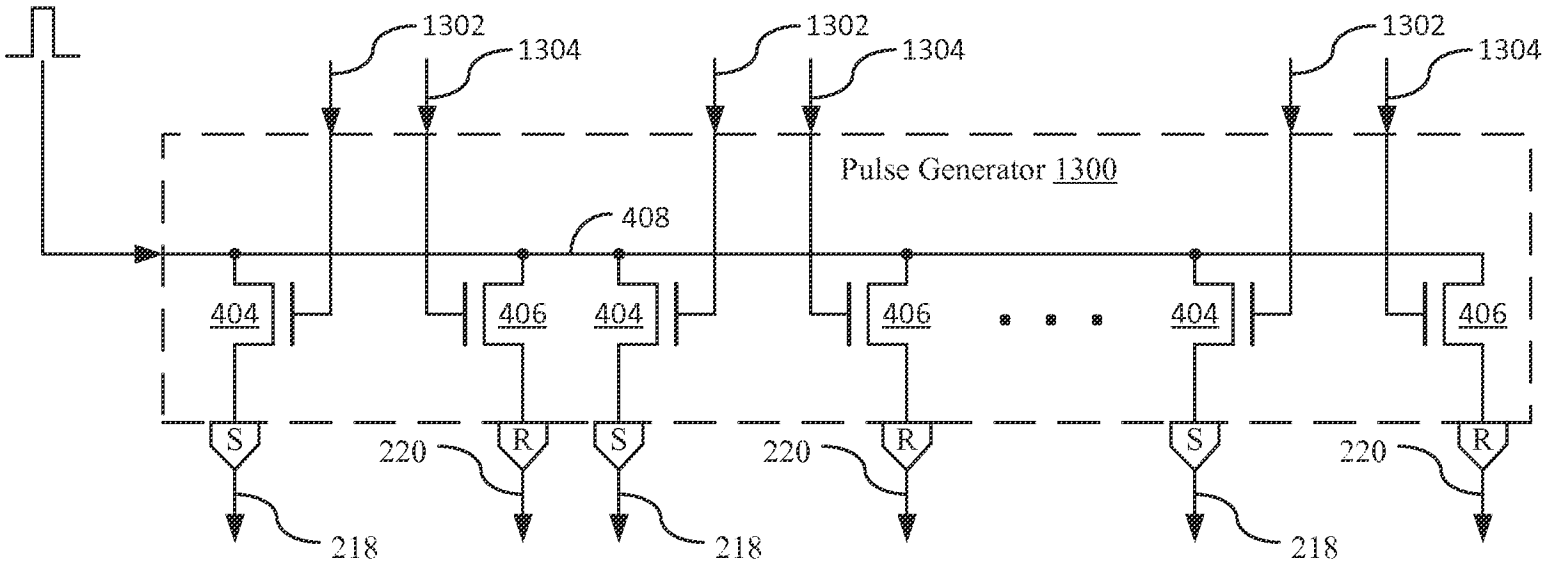
FIG. 13 is a simplified circuit diagram for an alternate pulse generator.

FIG. 13 is a simplified circuit diagram for an alternate pulse generator 1300. Pulse generator 1300 includes a set input 1302 and a reset input 1304 for each column of pixel cells 200 in a display. The signals applied to set input 1302 and reset input 1304 are essentially a 2-bit data word that selectively communicates a pulse on pulse line 408 to either set signal line 218, reset signal line 220, or neither. In particular, the two bit value (10) will enable gate 404 and communicate a pulse on pulse line 408 to set signal line 218. The two bit value (01) will enable gate 406 and communicate a pulse on pulse line 408 to reset signal line 220. The two bit value (00) prevents a pulse on pulse line 408 from being communicated to either set signal line 218 or reset signal line 220. Finally, the value (11) is an invalid value that should not be used, because the value (11) would enable gate 404 and 406, resulting in a pulse on both set line 404 and reset line 406, which would cause an error in pixel cell 202.

The simplicity of pulse generator 1300 provides flexibility and allows pulse generator (and the display in which it is incorporated) to be used with any desired set/reset data scheme and modulation period. The desired data scheme and modulation period would be implemented in a display driver circuit, which would provide set (10) and reset (01) data to pulse generator 1300, but display data would not need to be provided.

Figure 14:
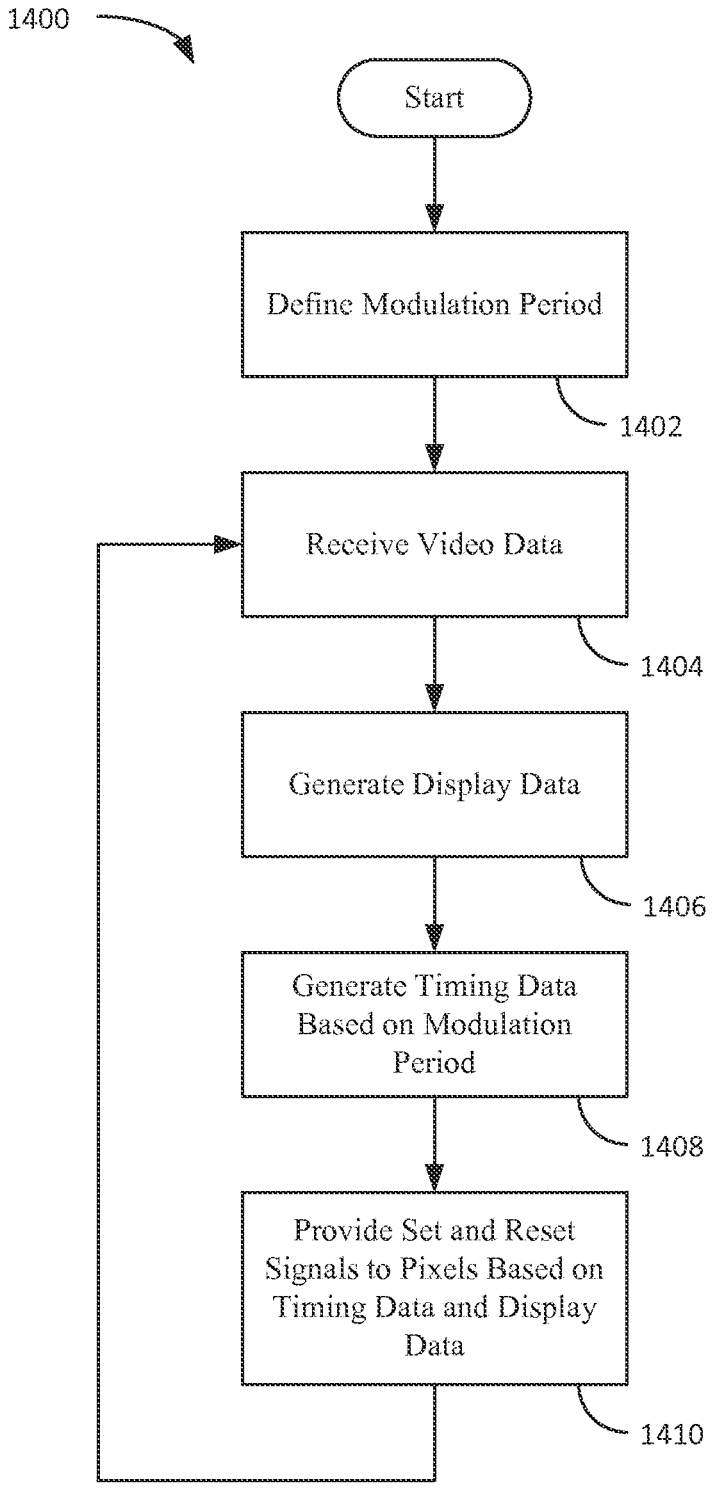
FIG. 14 is a flow chart summarizing an example method of modulating a multi-pixel display.

FIG. 14 is a flow chart summarizing an example method of modulating a multi-pixel display. In a first step 1402, a modulation period is defined. Then, in a second step 1404, video data is received. Next, in a third step 1406, display data is generated based on the video data. Then, in a fourth step 1408, timing data is generated based on the modulation period. Finally, in a fifth step 1410, set and reset signals are provided to pixels of a display based on the timing and the display data.

Figure 15:
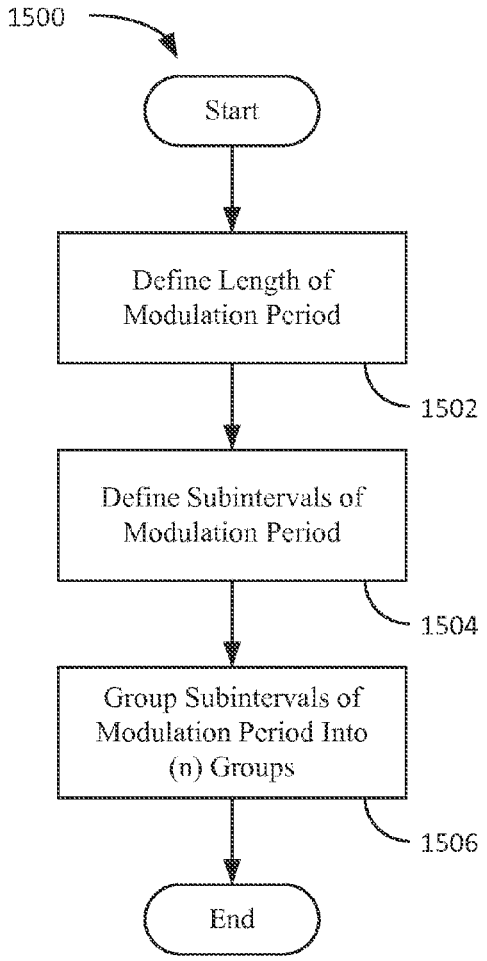
FIG. 15 is a flow chart summarizing an example method of performing the "Define Modulation Period" step of the method of FIG. 14.

FIG. 15 is a flow chart summarizing an example method 1500 of performing the "Define Modulation Period" step 1402 of method 1400 of FIG. 14. In a first step 1502, the length of the modulation period is defined. Then, in a second step 1504, subintervals of the modulation period are defined. Finally, in a third step 1506, the subintervals of the modulation period are grouped into (n) groups.

Figure 16:
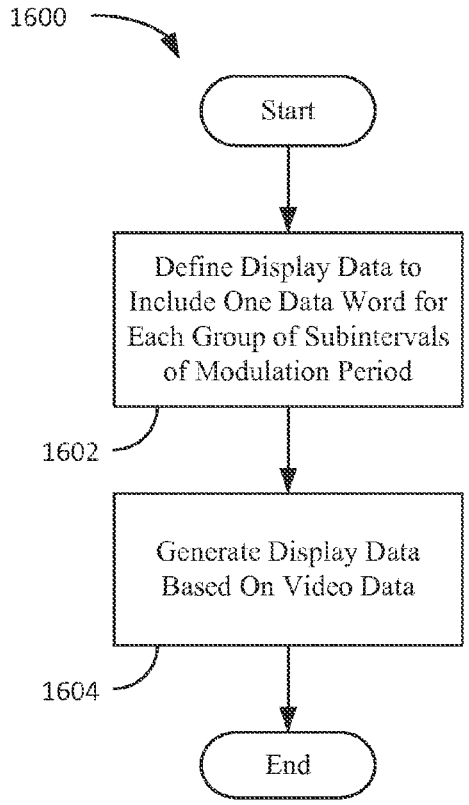
FIG. 16 is a flow chart summarizing an example method of performing the "Generate Display Data" step of the method of FIG. 14.

FIG. 16 is a flow chart summarizing an example method 1600 of performing the "Generate Display Data" step 1506 of method 1400 of FIG. 14. In a first step the display data is defined to include one data word for each group of subintervals of the modulation period. Then, in a second step 1604, the display data is generated based on the video data.

The description of particular embodiments of the present invention is now complete. Many of the described features may be substituted, altered or omitted without departing from the scope of the invention. For example, the output of the pixel set/reset circuits can drive the pixel mirrors directly, instead of using a multiplexer to drive the pixel mirrors. In addition, each row of pixels can be driven asynchronously, such that the rows are processed during distinct modulation periods that are temporally offset with respect to one another. As yet another example, although the second embodiment is described as using display data with two groups of bits (N and B), the present invention can be used with display data having a greater number of bit groups. These and other deviations from the particular embodiments shown will be apparent to those skilled in the art, particularly in view of the foregoing disclosure.

We claim:

1. A display comprising:

a pixel cell including a set terminal, a reset terminal, an output terminal, and a set/reset circuit coupled to receive a set signal via said set terminal and a reset signal via said reset terminal; and wherein said set/reset circuit responsive to receiving a set signal on said set terminal is operative to assert a first signal on said output terminal and to maintain said first signal on said output terminal until a reset signal is received on said reset terminal;

said set/reset circuit responsive to receiving a reset signal on said reset terminal is operative to assert a second signal on said output terminal and to maintain said second signal on said output terminal until a set signal is received on said set terminal; and an optical output of said pixel depends on when said first signal and said second signal are asserted on said output terminal of said set/reset circuit during a predefined modulation period; and wherein said optical output of said pixel depends on multi-bit display data; and bits of said multi-bit display data are not written into said pixel cell.

2. The display of claim 1, additionally comprising:

a set signal line coupled to said set terminal of said pixel cell;

a reset line coupled to said reset terminal of said pixel cell; and a logic circuit having a display data input terminal set coupled to receive display data indicative of an intensity value to be displayed by said pixel and a timing data input terminal set coupled to receive timing data indicative of a particular portion of said modulation period, said logic circuit being operative to selectively assert a set signal on said set signal line, a reset signal on said reset signal line, or no signal on either of said set signal line or said reset signal line depending on values of said display data and said timing data.

3. The display of claim 2, additionally comprising:

a plurality of said pixel cells; and wherein said set terminal of each of said plurality of pixel cells is coupled to said set signal line; and said reset terminal of each of said plurality of pixel cells is coupled to said reset signal line.

4. The display of claim 3, wherein said plurality of said pixel cells, said set signal line, and said reset signal line are arranged to form a column of pixel cells in said display.

5. The display of claim 4, additionally comprising a plurality of said columns of pixel cells, each said column of pixel cells including a plurality of pixel cells, a set signal line and a reset signal line.

6. The display of claim 1, wherein said pixel cell additionally comprises:

a pixel electrode; and a switch having a first input coupled to a first voltage supply line, a second input coupled to a second voltage supply line, and a control terminal coupled to said output terminal of said set/reset circuit; and wherein responsive to said first signal being asserted on said output terminal of said set/reset circuit, said switch is operable to couple said first voltage supply line to said pixel electrode; and responsive to said second signal being asserted on said output terminal of said set/reset circuit, said switch is operable to couple said second voltage supply line to said pixel electrode.

7. The display of claim 1, additionally comprising a set signal line coupled to said set terminal of said pixel cell;

a reset line coupled to said reset terminal of said pixel cell;

a logic circuit having a display data input terminal set coupled to receive display data indicative of an intensity value to be displayed by said pixel and a timing data input terminal set coupled to receive timing data indicative of a particular portion of said modulation period, said logic circuit being operative to selectively assert a set signal on said set signal line, a reset signal on said reset signal line, or no signal on either of said set signal line or said reset signal line depending on values of said display data and said timing data; and a driver circuit coupled to provide said display data to said display data input terminal set of said logic circuit, said driver circuit including a video data input terminal set for receiving video data from a video data source and being operative to generate said display data based on said video data.

8. The display of claim 7, wherein said display data is the same as said video data.

9. The display of claim 7, wherein:

said video data defines a plurality of intensity values to be displayed by said pixel;

said driver circuit is operable to define said modulation period during which one of said intensity values is to be displayed by said pixel, and to also define subintervals of said modulation period during which said set/reset circuit is either in a set state or a reset state; and an intensity displayed by said pixel during said modulation period corresponds to a number of subintervals of said modulation period during which said set/reset circuit is in a set state.

10. The display of claim 9, wherein:

said video data includes (n) bits; and said modulation period includes $2^n-1$ subintervals.

11. The display of claim 10, wherein:

said set signal is a pulse;

said reset signal is a pulse;

no more than one pulse is asserted on said set signal terminal of each said pixel during each said modulation period; and no more than one pulse is asserted on said reset terminal of each said pixel during each said modulation period.

12. The display of claim 1, wherein:

said first signal has a first predetermined value; and said second signal has a second predetermined value.

13. The display of claim 1, wherein:

said optical output of said pixel depends on values of said display data;

said first signal has a value that is independent of said display data; and said second signal has a value that is independent of said display data.

14. The display of claim 1, wherein:

one of said first signal and said second signal is always an "on" signal; and the other of said first signal and said second signal is always an "off" signal.

* * * * *